US012799671B2

(12) United States Patent
Maeda et al.

(10) Patent No.: US 12,799,671 B2
(45) Date of Patent: Nov. 17, 2026

(54) CARBON FIBER PRECURSOR TREATMENT AGENT AND CARBON FIBER PRECURSOR

(71) Applicant: TAKEMOTO YUSHI KABUSHIKI KAISHA, Gamagori (JP)

(72) Inventors: Motoki Maeda, Gamagori (JP); Yohei Suzuki, Gamagori (JP); Keiichiro Oshima, Gamagori (JP)

(73) Assignee: TAKEMOTO YUSHI KABUSHIKI KAISHA, Gamagori (JP)

( * ) Notice: Subject to any disclaimer, the term of this patent is extended or adjusted under 35 U.S.C. 154(b) by 0 days.

(21) Appl. No.: 16/917,364

(22) Filed: Jun. 30, 2020

(65) Prior Publication Data

US 2021/0002820 A1 Jan. 7, 2021

(30) Foreign Application Priority Data

Jul. 5, 2019 (JP) ..... 2019-126390

(51) Int. Cl.

| | |
|---|---|
| ***D06M 15/643*** | (2006.01) |
| ***D06M 13/256*** | (2006.01) |
| ***D06M 13/288*** | (2006.01) |
| ***D06M 15/647*** | (2006.01) |
| ***D06M 101/40*** | (2006.01) |

(52) U.S. Cl.

CPC ..... *D06M 15/6436* (2013.01); *D06M 13/256* (2013.01); *D06M 13/288* (2013.01); *D06M 15/647* (2013.01); *D06M 2101/40* (2013.01)

(58) Field of Classification Search

CPC ..... D06M 15/6436; D06M 13/256; D06M 15/647; D06M 13/288; D06M 2101/40; D06M 15/37; D06M 15/53; D06M 15/643; D06M 13/463; D06M 13/46; D06M 13/262; D06M 13/282; D06M 13/248; D06M 2200/30; D06M 11/38; D06M 13/11; D06M 2101/28

See application file for complete search history.

(56) References Cited

U.S. PATENT DOCUMENTS

| | | | | |
|---|---|---|---|---|
| 5,061,384 | A | 10/1991 | Suzuki et al. | |
| 6,537,657 | B1 * | 3/2003 | Watanabe | B41M 5/41 428/483 |
| 7,976,945 | B2 * | 7/2011 | Kawakami | D01F 6/18 428/367 |
| 8,323,743 | B2 * | 12/2012 | Nakayama | D06M 15/6436 427/377 |
| 9,249,295 | B2 * | 2/2016 | Nakayama | C08L 63/04 |
| 9,765,448 | B2 * | 9/2017 | Higuchi | C08F 120/44 |
| 2010/0210745 | A1 * | 8/2010 | McDaniel | C09D 5/1668 521/55 |
| 2011/0240064 | A1 * | 10/2011 | Wales | C09D 7/47 134/26 |
| 2011/0250626 | A1 * | 10/2011 | Williams | C09D 189/00 435/18 |
| 2012/0097194 | A1 * | 4/2012 | McDaniel | C09D 7/65 134/26 |
| 2013/0084455 | A1 * | 4/2013 | Naskar | D06M 13/248 428/367 |
| 2014/0128629 | A1 * | 5/2014 | Bradaric-Baus | C07F 9/38 558/39 |
| 2014/0196631 | A1 * | 7/2014 | McDaniel | C09D 7/65 106/124.1 |
| 2015/0044125 | A1 | 2/2015 | Hashimoto et al. | |
| 2015/0191607 | A1 * | 7/2015 | McDaniel | C09D 7/48 424/409 |
| 2019/0062954 | A1 | 2/2019 | Abels et al. | |
| 2019/0234014 | A1 | 8/2019 | Arakawa et al. | |

FOREIGN PATENT DOCUMENTS

| | | | | |
|---|---|---|---|---|
| CN | 109563680 | A | 4/2019 | |
| GB | 2563322 | A * | 12/2018 | B09B 5/00 |
| JP | H0192474 | A | 4/1989 | |
| JP | H0192475 | A | 4/1989 | |
| JP | 2003171879 | A | 6/2003 | |
| JP | 4817685 | B2 * | 11/2011 | |
| JP | 2012046855 | A | 3/2012 | |
| JP | 2013163888 | A * | 8/2013 | |
| JP | 2018193660 | A | 12/2018 | |
| WO | 2013129115 | A1 | 6/2013 | |
| WO | WO-2014050639 | A1 * | 4/2014 | D01F 11/06 |
| WO | WO-2017102307 | A1 * | 6/2017 | C11D 1/62 |

OTHER PUBLICATIONS

Google Patents Translation of JP2013163888A (Year: 2013).*
https://en.wikipedia.org/wiki/Phosphonium (Year: 2023).*

(Continued)

*Primary Examiner* — Angela C Brown-Pettigrew

*Assistant Examiner* — Preeti Kumar

(74) *Attorney, Agent, or Firm* — CANTOR COLBURN LLP

(57) ABSTRACT

A carbon fiber precursor treatment agent contains a smoothing agent that includes an amino-modified silicone, at least one onium salt selected from the group consisting of organic sulfuric acid phosphonium salts, organic sulfonic acid phosphonium salts, quaternary ammonium salts of an organic sulfuric acid having an alkyl group with not less than 3 carbon atoms in the molecule, and quaternary ammonium salts of an organic sulfonic acid having an alkyl group with not less than 3 carbon atoms in the molecule, and a nonionic surfactant.

4 Claims, No Drawings

(56) References Cited

OTHER PUBLICATIONS

Google Patents English Translation of WO2014050639A1 (Year: 2014).*
Google Patents Translation of JP-4817685-B2 https://patents.google.com/patent/JP4817685B2/en?oq=JP4817685B (Year: 2011).*
Office Action and English Translation of Office Action issued in Japanese Patent Application No. 2019-126390, drafted Aug. 27, 2019; 6 pages.
Office Action and English Translation of Office Action issued in German Patent Application No. 10 2020 117 303.2, mailed Nov. 17, 2021, 14 pages.

* cited by examiner

CARBON FIBER PRECURSOR TREATMENT AGENT AND CARBON FIBER PRECURSOR

Priority under 35 U.S.C. § 119 (a) and 35 U.S.C. § 365 (b) is claimed from Japanese Patent Application No. 2019-126390, filed on Jul. 5, 2019, the disclosure of which is also incorporated herein by reference.

TECHNICAL FIELD

The present invention relates to a carbon fiber precursor treatment agent and a carbon fiber precursor to which the carbon fiber precursor treatment agent is adhered.

BACKGROUND ART

Generally, carbon fibers are widely used in respective fields of building materials, transportation equipment, etc., for example, as a carbon fiber composite in combination with a matrix resin such as an epoxy resin. Carbon fibers are manufactured, for example, by manufacturing a carbon fiber precursor by performing a spinning process of spinning acrylic fibers and a stretching process of stretching the fibers and then performing a flameproofing process and a carbonization process on the carbon fiber precursor. A carbon fiber precursor treatment agent is used at times on the carbon fiber precursor to suppress agglutination or fusion among fibers that occurs in the carbon fiber manufacturing process.

WO 2013/129115 discloses a carbon fiber precursor treatment agent containing a modified silicone and an acidic phosphoric acid ester, the modified silicone having a modified group that includes a nitrogen atom, thereby improving solution stability of the treatment agent, suppressing gum-up during spinning of the carbon fiber precursor, and suppressing fusion of the carbon fibers during baking.

SUMMARY OF THE INVENTION

Problems that are to be Solved by the Invention

With the conventional carbon fiber precursor treatment agent, an effect of imparting a bundling property to the carbon fiber precursor in the flameproofing process is insufficient.

Thus, a problem to be solved by the present invention is to improve a bundling property of flameproofed fibers in a flameproofing process.

Means for Solving the Problems

A carbon fiber precursor treatment agent that solves the above problem contains a smoothing agent, at least one onium salt selected from the group consisting of organic sulfuric acid phosphonium salts, organic sulfonic acid phosphonium salts, quaternary ammonium salts of an organic sulfuric acid having an alkyl group with not less than 3 carbon atoms in the molecule, and quaternary ammonium salts of an organic sulfonic acid having an alkyl group with not less than 3 carbon atoms in the molecule, and a nonionic surfactant.

The onium salt preferably includes at least one selected from the group consisting of organic sulfuric acid phosphonium salts and organic sulfonic acid phosphonium salts.

The onium salt preferably includes at least one selected from the group consisting of organic sulfuric acid phosphonium salts in which all substituents bonded to the phosphorus atom in the molecule are alkyl groups with not less than 3 carbon atoms and organic sulfonic acid phosphonium salts in which all substituents bonded to the phosphorus atom in the molecule are alkyl groups with not less than 3 carbon atoms.

The smoothing agent preferably includes an amino-modified silicone.

The smoothing agent preferably includes an amino-modified silicone and a polyether-modified silicone.

When the total content of the smoothing agent and the onium salt in the carbon fiber precursor treatment agent is taken as 100 parts by mass, the content ratio of the onium salt is preferably 0.01 to 20 parts by mass.

The nonionic surfactant preferably includes a compound to which ethylene oxide is added at a ratio of 1 to 20 moles with respect to 1 mole of an aliphatic saturated alcohol with 4 to 20 carbon atoms.

The carbon fiber precursor that solves the above problem includes the carbon fiber precursor treatment agent adhered thereto.

Effect of the Invention

The present invention succeeds in improving a bundling property of flameproofed fibers in a flameproofing process.

MODES FOR CARRYING OUT THE INVENTION

First Embodiment

A first embodiment that embodies a carbon fiber precursor treatment agent according to the present invention (hereinafter referred to simply as "treatment agent") will now be described.

The treatment agent of the present embodiment contains a smoothing agent (A), a specific onium salt (B), and a nonionic surfactant (C). Details of the respective components contained in the treatment agent of the present embodiment will now be described.

(A) Smoothing Agent

Examples of the smoothing agent contained in the treatment agent of the present embodiment include a silicone and an ester.

The silicone used as the smoothing agent is not restricted in particular. Examples thereof include dimethyl silicones, phenyl-modified silicones, amino-modified silicones, amide-modified silicones, polyether-modified silicones, aminopolyether-modified silicones, alkyl-modified silicones, alkylaralkyl-modified silicones, alkylpolyether-modified silicones, ester-modified silicones, epoxy-modified silicones, carbinol-modified silicones, and mercapto-modified silicones.

The ester used as the smoothing agent is not restricted in particular. Examples thereof include (1) ester compounds of an aliphatic monoalcohol and an aliphatic monocarboxylic acid, such as octyl palmitate, oleyl laurate, oleyl oleate, and isotetracosyl oleate, (2) ester compounds of an aliphatic polyhydric alcohol and an aliphatic monocarboxylic acid, such as 1,6-hexanediol didecanoate, glycerin trioleate, trimethylolpropane trilaurate, and pentaerythritol tetraoctanoate, (3) ester compounds of an aliphatic monoalcohol and an aliphatic polycarboxylic acid, such as dioleyl azelate, dioleyl thiodipropionate, diisocetyl thiodipropionate, and diisostearyl thiodipropionate, (4) ester compounds of an aromatic monoalcohol and an aliphatic monocarboxylic acid, such as benzyl oleate and benzyl laurate, (5) complete ester compounds of an aromatic polyhydric alcohol and an aliphatic monocarboxylic acid, such as bisphenol A dilaurate and dilaurates of an alkylene oxide adduct of bisphenol A, (6) complete ester compounds of an aliphatic monoalcohol and an aromatic polycarboxylic acid, such as bis-2-ethylhexylphthalate, diisostearyl isophthalate, and trioctyl trimellitate, and (7) natural fats and oils, such as palm oil, rapeseed oil, sunflower oil, soybean oil, castor oil, sesame oil, fish oil, and beef tallow. Besides the above, a known smoothing agent adopted in a synthetic fiber treatment agent may be used.

One type of the smoothing agent may be used alone or two or more types may be used in combination.

The smoothing agent preferably includes an amino-modified silicone. An amino equivalent of the amino-modified silicone is preferably 500 to 10,000 g/mol. When the smoothing agent includes an amino-modified silicone, the carbon fibers obtained from the carbon fiber precursor added with the treatment agent is improved in strength. Also, the smoothing agent preferably includes an amino-modified silicone and a polyether-modified silicone. In this case, a bundling property in a spinning process to be described below is improved and at the same time, a bundling property in a flameproofing process to be described below is improved further.

A kinematic viscosity of the smoothing agent is preferably 10 $mm^2/s$ to 100,000 $mm^2/s$ at 25° C.

(B) Specific Onium Salt

The specific onium salt contained in the treatment agent of the present embodiment is at least one selected from the group consisting of organic sulfuric acid phosphonium salts, organic sulfonic acid phosphonium salts, quaternary ammonium salts of an organic sulfuric acid having an alkyl group with not less than 3 carbon atoms in the molecule, and quaternary ammonium salts of an organic sulfonic acid having an alkyl group with not less than 3 carbon atoms in the molecule.

The number of carbon atoms in the alkyl group is preferably not less than 4 and more preferably not less than 5. Also, the number of carbon atoms in the alkyl group is preferably not more than 20. The alkyl group may be either a normal chain or a branched chain but is preferably a normal chain.

Examples of the organic sulfuric acid constituting the organic sulfuric acid phosphonium salts include (1) alkyl sulfuric acid esters, such as ethyl sulfate, octyl sulfate, lauryl sulfate, tetradecyl sulfate, hexadecyl sulfate, and octadecyl sulfate, and (2) polyoxyalkylene alkyl ether sulfuric acids (with an average added number of moles of polyoxyalkylene being, for example, 1 to 25), such as polyoxyethylene lauryl ether sulfuric acid, and polyoxyalkylene alkylphenyl ether sulfuric acids (with an average added number of moles of polyoxyalkylene being, for example, 1 to 25), such as polyoxyethylene nonylphenyl ether sulfuric acid.

Examples of the organic sulfuric acid constituting the quaternary ammonium salts of the organic sulfuric acid having the alkyl group with not less than 3 carbon atoms in the molecule include (1) alkyl sulfuric acid esters, such as octyl sulfate, lauryl sulfate, tetradecyl sulfate, hexadecyl sulfate, octadecyl sulfate, and isooctadecyl sulfate, and (2) polyoxyalkylene alkyl ether sulfuric acids (with an average added number of moles of polyoxyalkylene being, for example, 1 to 25), such as polyoxyethylene lauryl ether sulfuric acid, polyoxyethylene tetradecyl ether sulfuric acid, polyoxyethylene hexadecyl ether sulfuric acid, polyoxyethylene octadecyl ether sulfuric acid, and polyoxyethylene isooctadecyl ether sulfuric acid and polyoxyalkylene alkylphenyl ether sulfuric acids (with an average added number of moles of polyoxyalkylene being, for example, 1 to 25), such as polyoxyethylene nonylphenyl ether sulfuric acid.

Examples of the organic sulfonic acid constituting the organic sulfonic acid phosphonium salts include (1) alkyl sulfonic acids, such as methanesulfonic acid, ethanesulfonic acid, hexyl sulfonic acid, heptyl sulfonic acid, 2-ethylhexyl sulfonic acid, octyl sulfonic acid, nonyl sulfonic acid, decyl sulfonic acid, undecyl sulfonic acid, dodecyl sulfonic acid, and tridecyl sulfonic acid, (2) alkylaryl sulfonic acids, such as p-toluenesulfonic acid, ethyl benzenesulfonic acid, decyl benzenesulfonic acid, undecyl benzenesulfonic acid, dodecyl benzenesulfonic acid, tridecyl benzenesulfonic acid, tetradecyl benzenesulfonic acid, pentadecyl benzenesulfonic acid, hexadecyl benzenesulfonic acid, and dibutyl naphthalenesulfonic acid, (3) diphenyl ether sulfonic acids, such as hexadecyl diphenyl ether disulfonic acid, and (4) ester sulfonic acids, such as dioctyl sulfosuccinate, dibutyl sulfosuccinate, dodecyl sulfoacetate, and nonylphenoxypolyethylene glycol sulfoacetate.

Examples of the organic sulfonic acid constituting the quaternary ammonium salts of the organic sulfonic acid having the alkyl group with not less than 3 carbon atoms in the molecule include (1) alkyl sulfonic acids, such as hexyl sulfonic acid, heptyl sulfonic acid, 2-ethylhexyl sulfonic acid, octyl sulfonic acid, nonyl sulfonic acid, decyl sulfonic acid, undecyl sulfonic acid, dodecyl sulfonic acid, and tridecyl sulfonic acid, (2) alkylaryl sulfonic acids, such as decyl benzenesulfonic acid, undecyl benzenesulfonic acid, dodecyl benzenesulfonic acid, tridecyl benzenesulfonic acid, tetradecyl benzenesulfonic acid, pentadecyl benzenesulfonic acid, hexadecyl benzenesulfonic acid, and dibutyl naphthalenesulfonic acid, (3) diphenyl ether sulfonic acids, such as hexadecyl diphenyl ether disulfonic acid, and (4) ester sulfonic acids, such as dioctyl sulfosuccinate, dibutyl sulfosuccinate, dodecyl sulfoacetate, and nonylphenoxypolyethylene glycol sulfoacetate.

Examples of the phosphonium constituting the organic sulfuric or sulfonic acid phosphonium salts include quaternary phosphoniums, such as tetramethylphosphonium, tetraethylphosphonium, tetrabutylphosphonium, tetraoctylphosphonium, dibutyldihexylphosphonium, trihexyltetradecylphosphonium, triethyloctylphosphonium, and triphenylmethylphosphonium.

Examples of the quaternary ammonium constituting the quaternary ammonium salts of the organic sulfuric or sulfonic acid having the alkyl group with not less than 3 carbon atoms in the molecule include tetrabutylammonium and trihexyltetradecylammonium.

One type of the specific onium salt may be used alone or two or more types may be used in combination.

The specific onium salt preferably includes at least one selected from the group consisting of organic sulfuric acid phosphonium salts and organic sulfonic acid phosphonium salts. Also, the specific onium salt more preferably includes at least one selected from the group consisting of organic sulfuric acid phosphonium salts in which all substituents bonded to the phosphorus atom in the molecule are alkyl groups with not less than 3 carbon atoms and organic sulfonic acid phosphonium salts in which all substituents bonded to the phosphorus atom in the molecule are alkyl groups with not less than 3 carbon atoms. In this case, an antistatic property can be imparted to the carbon fiber precursor with the treatment agent adhered.

(C) Nonionic Surfactant

The nonionic surfactant contained in the treatment agent of the present embodiment has no particular restriction.

Example thereof include a compound in which an alkylene oxide is added to an alcohol or a carboxylic acid.

Examples of the alcohol used as a raw material of the nonionic surfactant include (1) straight-chain alkyl alcohols, such as methanol, ethanol, propanol, butanol, pentanol, hexanol, octanol, nonanol, decanol, undecanol, dodecanol, tridecanol, tetradecanol, pentadecanol, hexadecanol, heptadecanol, octadecanol, nonadecanol, eicosanol, heneicosanol, docosanol, tricosanol, tetracosanol, pentacosanol, hexacosanol, heptacosanol, octacosanol, nonacosanol, and triacontanol, (2) branched alkyl alcohols, such as isopropanol, isobutanol, isohexanol, 2-ethylhexanol, isononanol, isodecanol, isododecanol, isotridecanol, isotetradecanol, isotriacontanol, isohexadecanol, isoheptadecanol, isooctadecanol, isononadecanol, isoeicosanol, isoheneicosanol, isodocosanol, isotricosanol, isotetracosanol, isopentacosanol, isohexacosanol, isoheptacosanol, isooctacosanol, isononacosanol, and isopentadecanol, (3) straight-chain alkenyl alcohols, such as tetradecenol, hexadecenol, heptadecenol, octadecenol, and nonadecenol, (4) branched alkenyl alcohols, such as isohexadecenol and isooctadecenol, (5) cyclic alkyl alcohols, such as cyclopentanol and cyclohexanol, and (6) aromatic alcohols, such as phenol, nonylphenol, benzyl alcohol, monostyrenated phenol, distyrenated phenol, and tristyrenated phenol.

Examples of the carboxylic acid used as a raw material of the nonionic surfactant include (1) straight-chain alkyl carboxylic acids, such as octylic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, and docosanoic acid, (2) branched alkyl carboxylic acids, such as 2-ethylhexanoic acid, isododecanoic acid, isotridecanoic acid, isotetradecanoic acid, isohexadecanoic acid, and isooctadecanoic acid, (3) straight-chain alkenyl carboxylic acids, such as octadecenoic acid, octadecadienoic acid, and octadecatrienoic acid, and (4) aromatic carboxylic acids, such as benzoic acid.

Examples of the alkylene oxide used as a raw material of the nonionic surfactant include ethylene oxide and propylene oxide.

One type of the nonionic surfactant may be used alone or two or more types may be used in combination.

The nonionic surfactant preferably includes a compound to which ethylene oxide is added at a ratio of 1 to 20 moles with respect to 1 mole of a straight-chain alkyl alcohol or other aliphatic saturated alcohol with 4 to 20 carbon atoms. In this case, the treatment agent is improved in stability.

(D) Other Components

Other components ordinarily used in a carbon fiber precursor treatment agent may further be contained in the treatment agent of the present embodiment within a range that does not impair the effects of the present invention. Examples of the other components include binders, antioxidants, ultraviolet absorbers, and other stabilizers for quality maintenance of the treatment agent and antistatic agents. One type of the other components may be used alone or two or more types may be used in combination.

Next, the content ratios of the respective components in the treatment agent of the present embodiment will be described. The content ratios of the respective components in the treatment agent of the present embodiment are not restricted in particular but are preferably as follows.

When the total content of the smoothing agent (A), the specific onium salt (B), and the nonionic surfactant (C) in the treatment agent (hereinafter referred to as "total content of the main components") is taken as 100 parts by mass, the content ratio of the smoothing agent (A) is preferably 29.9 to 95 parts by mass and more preferably 60 to 90 parts by mass.

When the total content of the main components is taken as 100 parts by mass, the content ratio of the specific onium salt (B) is preferably 0.1 to 30 parts by mass and more preferably 0.5 to 25 parts by mass. Also, when the total content of the smoothing agent and the specific onium salt in the treatment agent is taken as 100 parts by mass, the content ratio of the specific onium salt (B) is preferably 0.01 to 20 parts by mass. In this case, the effect of imparting the antistatic property and the effect of improving the strength of the carbon fibers can be obtained readily.

When the total content of the main components is taken as 100 parts by mass, the content ratio of the nonionic surfactant (C) is preferably 1 to 70 parts by mass and more preferably 5 to 30 parts by mass.

When the total content of nonvolatile components in the treatment agent of the present embodiment is taken as 100 parts by mass, the sum of the content ratios of the smoothing agent (A), the specific onium salt (B), and the nonionic surfactant (C) is preferably not less than 50 parts by mass and more preferably not less than 75 parts by mass.

Second Embodiment

Next, a second embodiment that embodies a carbon fiber precursor according to the present invention will be described.

The carbon fiber precursor of the present embodiment includes a fiber portion formed by spinning raw material fibers and the treatment agent of the first embodiment that is adhered to the fiber portion. Carbon fibers are manufactured by performing on the carbon fiber precursor of the present embodiment a flameproofing process of converting to flameproofed fibers in an oxidizing atmosphere at 200° C. to 300° C. and preferably 230° C. to 270° C. and a carbonization process of carbonizing the flameproofed fibers in an inert atmosphere at 300° C. to 2,000° C. and preferably 300° C. to 1,300° C.

Examples of the raw material fibers include acrylic fibers. The acrylic fibers are preferably constituted of fibers with a main component of polyacrylonitrile obtained by copolymerizing not less than 90% by mole of acrylonitrile and not more than 10% by mole of a flameproofing promoting component. As the flameproofing promoting component, for example, a vinyl-group-containing compound having copolymerizability with acrylonitrile can be used favorably.

The treatment agent of the first embodiment is not restricted in particular in adhesion amount to the carbon fiber precursor but is preferably adhered such as to be 0.1% to 2% by mass and more preferably adhered such as to be 0.3% to 1.2% by mass with respect to the carbon fiber precursor. The above concentrations are solids concentrations not including a solvent.

A single fiber fineness of the carbon fiber precursor is not restricted in particular but is preferably 0.1 to 2.0 dTex from a standpoint of balance of performance and manufacturing cost. The number of single fibers constituting a fiber bundle of the carbon fiber precursor is not restricted in particular but is preferably 1,000 to 96,000 fibers from the standpoint of balance of performance and manufacturing cost.

The carbon fiber precursor can be manufactured by a yarn manufacturing process of spinning and drawing the raw material fibers. In the yarn manufacturing process, for example, the spinning process of spinning the raw material fibers, an adhesion process of adhering the treatment agent of the first embodiment to the spun fibers, and the drawing process of drawing the spun fibers are performed successively. Although the raw material fibers are drawn from immediately after being spun, a high ratio drawing after the adhesion process shall be referred to in particular as the "drawing process."

The adhesion process is a process of adhering the treatment agent of the first embodiment after spinning the raw material fibers. That is, the treatment agent of the first embodiment is adhered to the raw material fibers in the adhesion process.

A known method can be applied as a method of adhesion of the treatment agent of the first embodiment in the adhesion process. Examples of the known adhesion method include a spray oiling method, an immersion oiling method, a roller oiling method, and a guide oiling method using a metering pump. A form of the treatment agent in adhering the treatment agent of the first embodiment to the fibers may, for example, be an organic solvent solution or an aqueous liquid.

A known method can be applied as a drawing method in the drawing process. Examples of the known drawing method include a wet heat drawing method using high temperature steam and a dry heat drawing method using a hot roller.

A timing of adhering the treatment agent of the first embodiment and the number of times of adhering the treatment agent of the first embodiment in the yarn manufacturing process are not restricted in particular. For example, adhesion to the raw material fibers before the spinning process may be performed or adhesion after the drawing process may be performed. Examples of a timing of performing adhesion after the drawing process include immediately after the drawing process, at a stage of a winding process after the drawing process, and immediately before the flameproofing process. The treatment agent of the first embodiment is preferably adhered once before the drawing process and it is more preferable to perform adhesion once before the drawing process and perform adhesion again immediately after the drawing process.

Effects of the first embodiment and the second embodiment will now be described.

(1) The treatment agent of the first embodiment contains a smoothing agent (A), a specific onium salt (B), and a nonionic surfactant (C). The carbon fiber precursor of the second embodiment includes the treatment agent of the first embodiment adhered thereto. By the above features, in manufacturing the carbon fibers from the carbon fiber precursor with the treatment agent adhered, the bundling property of the flameproofed fibers in the flameproofing process is improved. Further, by the above features, it is possible to impart the antistatic property to the carbon fiber precursor with the treatment agent adhered, improve the strength of the carbon fibers obtained from the carbon fiber precursor with the treatment agent adhered, and improve the bundling property in the spinning process in manufacturing the carbon fiber precursor.

(2) The specific onium salt (B) may include at least one selected from the group consisting of organic sulfuric acid phosphonium salts and organic sulfonic acid phosphonium salts. By the above feature, the effects of (1) above can be obtained more pronouncedly.

(3) The specific onium salt (B) may include at least one selected from the group consisting of organic sulfuric acid phosphonium salts in which all substituents bonded to the phosphorus atom in the molecule are alkyl groups with not less than 3 carbon atoms and organic sulfonic acid phosphonium salts in which all substituents bonded to the phosphorus atom in the molecule are alkyl groups with not less than 3 carbon atoms. By the above feature, the effect of imparting the antistatic property to the carbon fiber precursor with the treatment agent adhered is improved. Electricity generated during running and winding of the carbon fiber precursor is thereby lessened to make the carbon fiber precursor easier to handle.

(4) The smoothing agent (A) may include an amino-modified silicone. By the above feature, the strength of the carbon fibers obtained from the carbon fiber precursor with the treatment agent adhered is improved.

(5) The smoothing agent (A) may include an amino-modified silicone and a polyether-modified silicone. By the above feature, in addition to the effect of (4) above, the bundling property in the spinning process in manufacturing the carbon fiber precursor is improved and at the same time, the bundling property of the flameproofed fibers in the flameproofing process is improved further.

(6) When the total content of the smoothing agent (A) and the specific onium salt (B) in the carbon fiber precursor treatment agent is taken as 100 parts by mass, the content ratio of the specific onium salt (B) may be 0.01 to 20 parts by mass. By the above feature, the effect of (3) above and the effect of (4) above can be obtained readily.

(7) The nonionic surfactant (C) may include a compound to which ethylene oxide is added at a ratio of 1 to 20 moles with respect to 1 mole of an aliphatic saturated alcohol with 4 to 20 carbon atoms. By the above feature, the stability of the treatment agent is improved.

EXAMPLES

Examples will now be given below to describe the features and effects of the present invention more specifically, but the present invention is not restricted to these examples. In the following description of working examples and comparative examples, parts means parts by mass and % means % by mass.

Experimental Part 1 (Preparation of Carbon Fiber Precursor Treatment Agents)

Example 1

Using the respective components shown in Table 1, 120 g of a smoothing agent (A-1), 40 g of a smoothing agent (A-4), 10 g of a specific onium salt (B-1), 20 g of a nonionic surfactant (C-1), and 10 g of a nonionic surfactant (C-2) were added to a beaker and mixed well by stirring. While continuing to stir, ion exchanged water was added gradually to attain a solids concentration of 25% and a 25% aqueous solution of a carbon fiber precursor treatment agent of Example 1 was thereby prepared.

Examples 2 to 13 and Comparative Examples 1 to 6

Respective carbon fiber precursor treatment agents of Examples 2 to 13 and Comparative Examples 1 to 6 were prepared using the respective components shown in Table 1 and by the same method as in Example 1.

TABLE 1

| | (A) Smoothing agent | | (B) Specific onium salt or other ionic component | | | (C) Nonionic surfactant | | Evaluations | | | |
|---|---|---|---|---|---|---|---|---|---|---|---|
| Category | Symbol | Content ratio (parts by mass) | Symbol | Content ratio (parts by mass) | Mass ratio B/(A + B) × 100 | Symbol | Content ratio (parts by mass) | Flameproofed fiber bundling property | Electrical resistance | Carbon fiber strength | Spun fiber bundling property |
| Ex. 1 | A-1 | 60 | B-1 | 5 | 5.9 | C-1 | 10 | ○○ | ○○ | ○○ | ○○ |
| | A-4 | 20 | | | | C-2 | 5 | | | | |
| Ex. 2 | A-2 | 65 | B-2 | 12 | 14.6 | C-1 | 10 | ○○ | ○○ | ○○ | ○○ |
| | A-4 | 5 | | | | C-3 | 8 | | | | |
| Ex. 3 | A-3 | 35 | B-3 | 3 | 3.8 | C-2 | 22 | ○○ | ○○ | ○○ | ○○ |
| | A-4 | 40 | | | | | | | | | |
| Ex. 4 | A-1 | 79 | B-1 | 4 | 4.8 | C-1 | 17 | ○ | ○○ | ○○ | ○ |
| Ex. 5 | A-2 | 75 | B-4 | 16 | 17.6 | C-1 | 9 | ○ | ○○ | ○○ | ○ |
| Ex. 6 | A-4 | 86 | B-2 | 1 | 1.1 | C-4 | 13 | ○ | ○○ | ○ | ○ |
| Ex. 7 | A-5 | 75 | B-3 | 3 | 3.8 | C-2 | 22 | ○ | ○○ | ○ | ○ |
| Ex. 8 | A-6 | 75 | B-1 | 5 | 6.3 | C-1 | 20 | ○ | ○○ | ○ | ○ |
| Ex. 9 | A-1 | 81 | B-5 | 5 | 5.8 | C-2 | 14 | ○ | ○ | ○ | ○ |
| Ex. 10 | A-2 | 76 | B-6 | 9 | 10.6 | C-5 | 15 | ○ | ○ | ○ | ○ |
| Ex. 11 | A-2 | 50 | B-4 | 25 | 33.3 | C-1 | 25 | ○ | ○ | ○ | ○ |
| Ex. 12 | A-1 | 74 | B-7 | 6 | 7.5 | C-1 | 20 | ○ | ○ | ○ | ○ |
| Ex. 13 | A-2 | 77 | B-8 | 4 | 4.9 | C-1 | 19 | ○ | ○ | ○ | ○ |
| Com. Ex. 1 | A-2 | 81 | rb-1 | 3 | 3.6 | C-1 | 16 | x | ○ | x | ○ |
| Com. Ex. 2 | A-3 | 82 | rb-2 | 4 | 4.7 | C-2 | 15 | x | ○ | x | x |
| Com. Ex. 3 | A-1 | 79 | rb-3 | 5 | 6.0 | C-1 | 16 | x | ○ | x | ○ |
| Com. Ex. 4 | A-1 | 80 | rb-4 | 5 | 5.9 | C-2 | 15 | x | x | x | x |
| Com. Ex. 5 | A-1 | 80 | rb-5 | 5 | 5.9 | C-1 | 15 | x | ○ | x | x |
| Com. Ex. 6 | A-1 | 80 | — | 0 | 0.0 | C-3 | 20 | x | x | ○ | x |

Details of the respective components of A-1 to A-6, B-1 to B-8, rb-1 to rb-5, and C-1 to C-5 indicated in the "Symbol" columns of Table 1 are as follows.

(Smoothing Agents)

A-1: amino-modified silicone with a kinematic viscosity at 25° C. of 650 $mm^2/s$ and an amino equivalent of 1,800 g/mol A-2: amino-modified silicone with a kinematic viscosity at 25° C. of 90 $mm^2/s$ and an amino equivalent of 5,000 g/mol A-3: amino-modified silicone with a kinematic viscosity at 25° C. of 1,400 $mm^2/s$ and an amino equivalent of 2,000 g/mol A-4: polyether-modified silicone with a kinematic viscosity at 25° C. of 1,700 $mm^2/s$, silicone main chain/polyether side chain=20/80 (mass ratio), and ethylene oxide/propylene oxide=50/50 (molar ratio)

A-5: epoxy-modified silicone with a kinematic viscosity at 25° C. of 17,000 $mm^2/s$ and an epoxy equivalent of 3,800 g/mol A-6: di(n-dodecyl) thiodipropionate (Specific Onium Salts)

B-1: tetrabutylphosphonium dodecyl benzenesulfonate

B-2: 5 mole ethylene oxide adduct of tetraoctylphosphonium lauryl ether sulfate

B-3: dibutyldihexylphosphonium ethanesulfonate

B-4: trihexyltetradecylphosphonium octadecyl sulfate

B-5: triethyloctylphosphonium dodecyl sulfonate

B-6: triphenylmethylphosphonium hexyl sulfonate

B-7: tetrabutylammonium dodecyl benzenesulfonate

B-8: trihexyltetradecylammonium octyl sulfate (Other Ionic Components)

rb-1: dodecyl benzenesulfonic acid rb-2: tetraethylammonium ethyl sulfate rb-3: 2ethylhexyl phosphate rb-4: sodium sulfate 4v-5: sodium dodecyl benzenesulfonate (Nonionic Surfactants)

C-1: 10 mole ethylene oxide adduct of isododecyl alcohol

C-2: 5 mole ethylene oxide adduct of isooctadecyl alcohol

C-3: 5 mole ethylene oxide adduct of hexyl alcohol

C-4: 18 mole ethylene oxide adduct of tetradecyl alcohol

C-5: 7 mole ethylene oxide adduct of nonylphenol

Experimental Part 2 (Preparation of Carbon Fiber Precursor and Carbon Fibers)

Carbon fiber precursors and carbon fibers were manufactured using the carbon fiber precursor treatment agents prepared in Experimental Part 1.

A copolymer of 1.80 limiting viscosity constituted of 95% by mass acrylonitrile, 3.5% by mass methyl acrylate, and 1.5% by mass methacrylic acid was dissolved in dimethylacetamide (DMAC) to prepare a spinning dope with a polymer concentration of 21.0% by mass and a viscosity at 60° C. of 500 poise. The spinning dope was discharged at a draft ratio of 0.8 from a spinneret with 12,000 holes of 0.075 mm hole diameter (inner diameter) into a coagulation bath of a 70% by mass aqueous solution of DMAC maintained at a spinning bath temperature of 35° C.

The coagulated yarn was drawn by 5 times at the same time as being desolvated in a rinse tank to prepare acrylic fiber strands (raw material fibers) in a water-swollen state. To these acrylic fiber strands, the carbon fiber precursor treatment agents prepared in Experimental Part 1 were each applied such that a solids adhesion amount would be 1% by mass (not including the solvent). Application of each carbon fiber precursor treatment agent was performed by an immersion method using a 4% ion exchanged water solution of the carbon fiber precursor treatment agent.

Thereafter, the acrylic fiber strands were subject to dry densification by a heating roller set at 130° C., further subject to drawing by 1.7 times between heating rollers set at 170° C., and thereafter wound around a bobbin to obtain a carbon fiber precursor.

Yarns were unwound from the wound carbon fiber precursor and, after being flameproofed for 1 hour under an air atmosphere in a flameproofing furnace having a temperature gradient of 230° C. to 270° C., were wound around a bobbin to obtain flameproofed yarns (flameproofed fibers). Further, yarns were unwound from the wound flameproofed yarns and, after conversion to carbon fibers by baking under a nitrogen atmosphere in a carbonizing furnace having a temperature gradient of 300° C. to 1,300° C., were wound around a bobbin to obtain the carbon fibers.

Experimental Part 3 (Evaluations)

Evaluation of Flameproofed Fiber Bundling Property

In the manufacturing process of the carbon fibers in Experimental Part 2, a bundling state of the flameproofed yarns after flameproofing and before being wound was observed visually and a flameproofed fiber bundling property was evaluated according to the following evaluation criteria. The results are shown in the "Flameproofed fiber bundling property" column of Table 1.

(excellent): The fibers are bundled and a tow width is constant.

(good): The fibers are bundled but the tow width is not constant.

x (poor): There are spaces within a fiber bundle and the fibers are not bundled.

Evaluation of Electrical Resistance

The carbon fiber precursor obtained in Experimental Part 2 was left for 24 hours under an atmosphere of 20° C.×65% RH, 10 g of the evaluation sample was placed in an electrical resistance measuring box (40 ml volume) under the same conditions, an electrical resistance value (log Ω) was measured using a megohm meter of tradename SM-5E type manufactured by Toa Electronics Ltd., and the electrical resistance was evaluated according to the following evaluation criteria. The results are shown in the "Electrical resistance" column of Table 1.

(excellent): Less than 9.

(good): Not less than 9 but less than 10.

x (poor): Not less than 10.

Evaluation of Carbon Fiber Strength

The strength of the carbon fibers obtained in Experimental Part 2 was measured in accordance with JIS R 7606 and was evaluated according to the following evaluation criteria. The results are shown in the "Carbon fiber strength" column of Table 1.

(excellent): Not less than 4.0 GPa.

(good): Not less than 3.5 GPa but less than 4.0 GPa.

x (poor): Less than 3.5 GPa.

Evaluation of Spun Fiber Bundling Property

In the manufacturing process of the carbon fiber precursor in Experimental Part 2, a bundling state of the carbon fiber precursor on a final roller immediately prior to being wound around the bobbin was observed visually and a spun fiber bundling property was evaluated according to the following evaluation criteria. The results are shown in the "Spun fiber bundling property" column of Table 1.

(excellent): The fibers are bundled and a tow width is constant.

(good): The fibers are bundled but the tow width is not constant.

x (poor): There are spaces within a fiber bundle and the fibers are not bundled.

As shown in Table 1, in comparison to cases of using the treatment agents of Comparative Examples 1 to 6 that do not contain a specific onium salt (B), the evaluation of the flameproofed fiber bundling property was improved in cases of using the treatment agents of Examples 1 to 13 each containing a smoothing agent (A), a specific onium salt (B), and a nonionic surfactant (C). Further, in the cases of using the treatment agents of Examples 1 to 13, excellent results were also obtained in the evaluation of the electrical resistance, the evaluation of the carbon fiber strength, and the evaluation of the spun fiber bundling property in addition to the evaluation of the flameproofed fiber bundling property.

In cases of using the treatment agents of Examples 1 to 8 each containing an organic sulfuric acid phosphonium salt or organic sulfonic acid phosphonium salt in which all substituents bonded to the phosphorus atom in the molecule are alkyl groups with not less than 3 carbon atoms as the specific onium salt (B), the evaluation of the electrical resistance was improved greatly in comparison to cases of using the treatment agents of Examples 9, 10, 12, and 13 in each of which the specific onium salt (B) is another specific onium salt.

In cases of using the treatment agents of Examples 1 to 5 each containing an amino-modified silicone as the smoothing agent (A), the evaluation of the carbon fiber strength was improved greatly in comparison to cases of using the treatment agents of Examples 6 to 8 that do not contain an amino-modified silicone. In particular, in cases of using the treatment agents of Examples 1 to 3 each containing an amino-modified silicone and a polyether-modified silicone as the smoothing agent (A), the evaluation of the flameproofed fiber bundling property and the evaluation of the spun fiber bundling property were improved greatly in addition to the evaluation of the carbon fiber strength.

From a comparison of the results of using the treatment agents of Example 5 and Example 11 that are the same in the respective components of the smoothing agent (A), the specific onium salt (B), and the nonionic surfactant (C) but differ in the content ratios of the smoothing agent (A) and the specific onium salt (B), it was possible to observe a tendency where the evaluation of the electrical resistance and the evaluation of the carbon fiber strength are readily improved by decreasing the mass ratio of the specific onium salt (B) with respect to the smoothing agent (A).

The invention claimed is:

1. A carbon fiber precursor treatment agent comprising:

a smoothing agent including an amino-modified silicone;

at least one onium salt selected from the group consisting of organic sulfuric acid phosphonium salts and organic sulfonic acid phosphonium salts; and a nonionic surfactant, wherein when the total content of the smoothing agent and the onium salt in the carbon fiber precursor treatment agent is taken as 100 parts by mass, the content ratio of the onium salt is 0.01 to 20 parts by mass;

wherein the nonionic surfactant includes a compound to which ethylene oxide is added at a ratio of 1 to 20 moles with respect to 1 mole of an aliphatic saturated alcohol with 4 to 20 carbon atoms.

2. The carbon fiber precursor treatment agent according to claim 1, wherein the onium salt includes at least one selected from the group consisting of organic sulfuric acid phosphonium salts in which all substituents bonded to the phosphorus atom in the molecule are alkyl groups with not less than 3 carbon atoms and organic sulfonic acid phosphonium salts in which all substituents bonded to the phosphorus atom in the molecule are alkyl groups with not less than 3 carbon atoms.

3. The carbon fiber precursor treatment agent according to claim 1, wherein the smoothing agent includes the amino-modified silicone and a polyether-modified silicone.

4. A carbon fiber precursor to which the carbon fiber precursor treatment agent according to claim 1 is adhered.

* * * * *